US005154148A

United States Patent [19]

Pyzik

[11] Patent Number: 5,154,148

[45] Date of Patent: Oct. 13, 1992

[54] FLEXIBLE MOUNT HEADER FOR ENGINE MOUNTED FUEL FILTER

[75] Inventor: Michael J. Pyzik, Chicago, Ill.

[73] Assignee: Navistar International Transportation Corp., Chicago, Ill.

[21] Appl. No.: 775,637

[22] Filed: Oct. 10, 1991

[51] Int. Cl.[5] ..... F02F 7/00

[52] U.S. Cl. ..... 123/195 A; 123/198 D

[58] Field of Search ..... 123/198 D, 195 A

*Primary Examiner*—Noah P. Kamen

*Attorney, Agent, or Firm*—Dennis K. Sullivan

[57] ABSTRACT

A flexible header mounting for an engine mounted fuel filter includes structure for dependingly engaging a fuel filter and its associated plumbing and a planar base member by means of which the header is mounted to the engine supporting structure. Flexible engagement of the base member to the engine is accomplished by means of bolts, each of which has a compression spring mounted thereon over the shaft thereof, between the base member and the bolt head. The free threaded end of the bolt extends through a bore drilled into the base member and engages within a threaded bore in the engine housing. The distance between a center point of the bolt and a forward edge of the base plate is as large as possible while the distance between the center point of the bolt and the rear edge is as small as possible, creating a joint wherein the header may pivot rearwardly upon impact but will be unable to pivot forwardly under severe deceleration.

13 Claims, 4 Drawing Sheets

FLEXIBLE MOUNT HEADER FOR ENGINE MOUNTED FUEL FILTER

BACKGROUND OF THE INVENTION

The present invention relates to a header for mounting a fuel filter to an engine and, more particularly, to a header which is flexibly mounted to an underlying surface of the engine to allow for rearward pivoting of the header and fuel filter mounted thereon relative to the engine to prevent the fuel filter from being damaged during a front end collision.

THE PRIOR ART

Heretofore, fuel filters have typically been mounted to an engine in a fixed, inflexible manner. Such inflexible mounting may have a disadvantage in some mounting arrangements that, in the event of a collision, a rigidly mounted filter, as well as its associated plumbing, could be damaged. For example, engine accessories mounted forward of the fuel filter might be pushed rearwardly and impact against the fuel filter to create a leakage of fuel, either from the filter or from the plumbing associated therewith.

SUMMARY OF THE INVENTION

It is a primary object of the invention described and claimed herein to provide an engine with a flexible mount filter header which allows for rearward pivoting of the header and the fuel filter engaged thereto when required, while keeping the header and filter from pivoting forwardly under the effect of forwardly directed inertial forces.

A further object of the invention is to provide a flexible mounted header for an engine mounted fuel filter to allow the fuel filter to pivot rearwardly to avoid damage by objects mounted forwardly of the fuel filter and thrust rearwardly thereagainst in the event of a front end collision.

Yet another object of the invention is to provide a flexible mount header which will not pivot forwardly under high forwardly directed inertial forces.

Yet a further object of the invention is to provide a flexible mount header which will not break away from its point of engagement to a supporting engine surface therebeneath.

These objects and others as may become apparent are specifically met in a flexible mount header for a fuel filter which includes structure for dependingly carrying a fuel filter and a spring biassed mounting system which includes a mounting base attached to the underlying engine structure in a manner permitting limited rearward pivotability of the header under impact loading while maximizing resistance to pivotability in the forward direction under the inertial loads caused by a severe deceleration.

BRIEF DESCRIPTION OF THE DRAWINGS

Other objects ad advantages of the invention will become more apparent upon perusal of the detailed description thereof and upon inspection of the drawings in which.

DESCRIPTION OF THE PREFERRED EMBODIMENT

Figure 1:
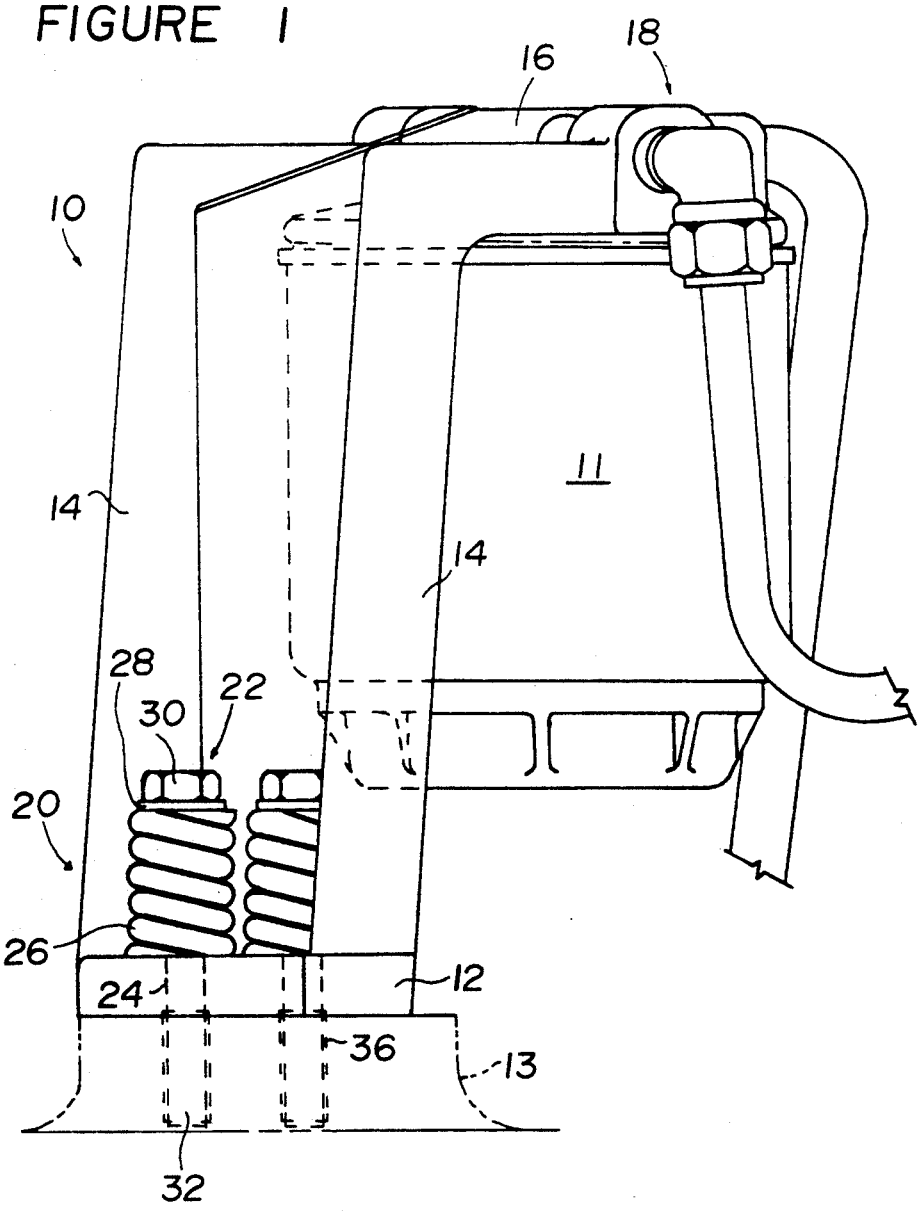
FIG. 1 is a rear perspective view of the header and fuel filter of the present invention flexibly mounted to a supporting surface of an engine.
Figure 2:
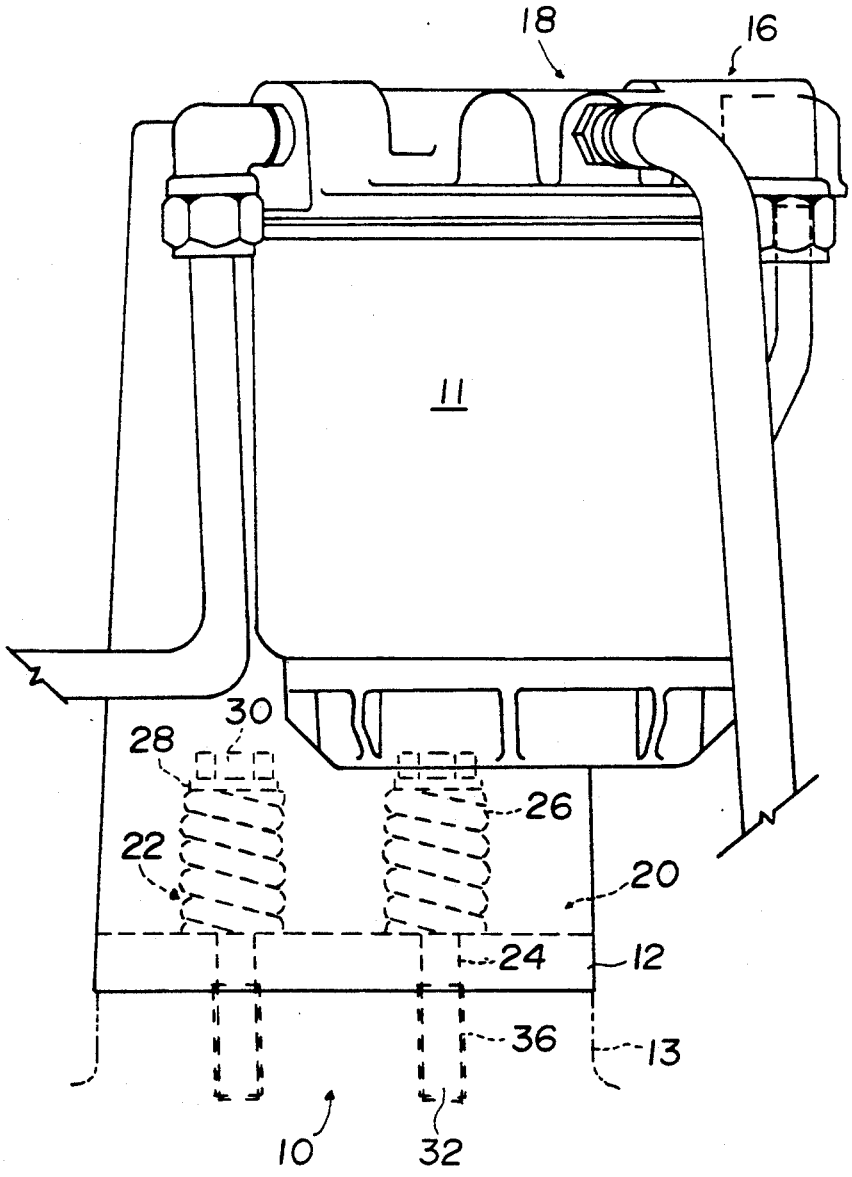
FIG. 2 is a front view of the header of FIG. 1.
Figure 3:
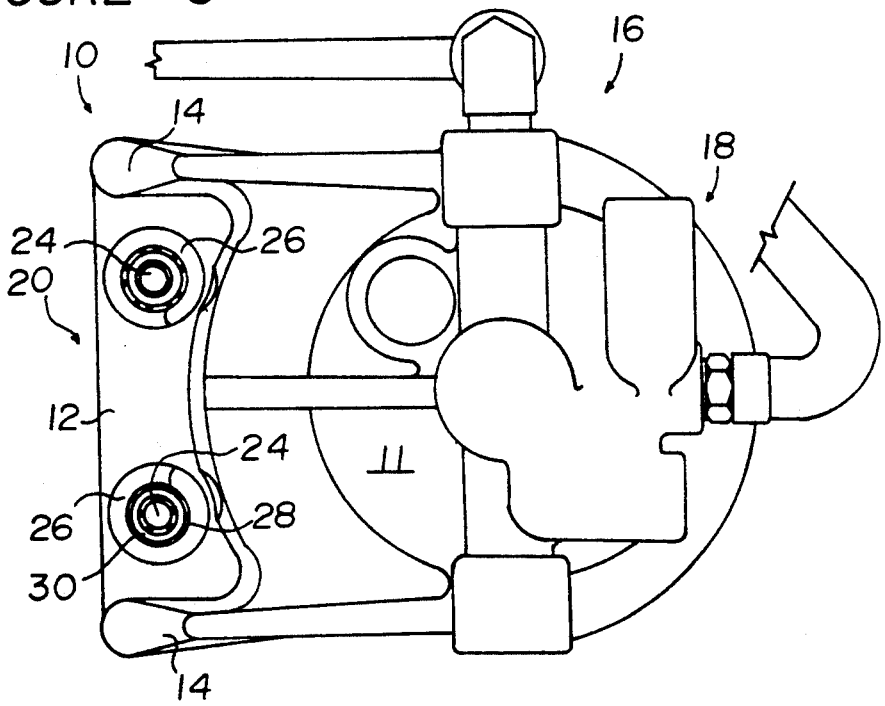
FIG. 3 is a plan view of the header of FIG. 1.
Figure 4:
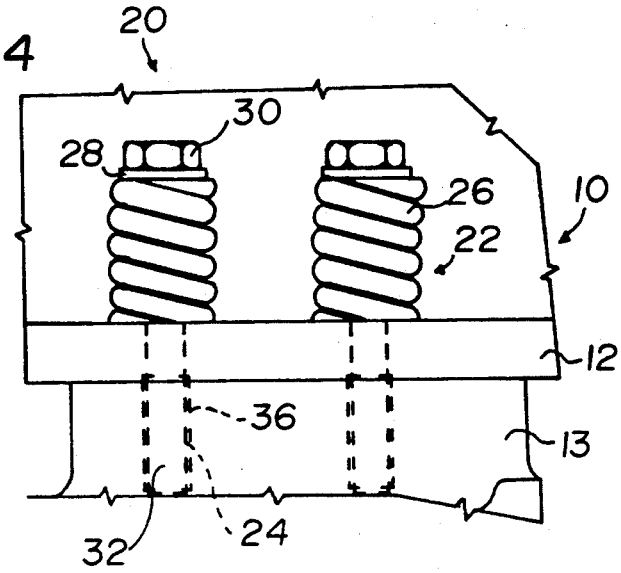
FIG. 4 is a rear view of the area of a portion of the header illustrating the engagement means for flexibly mounting the header to the engine.

Referring now to the drawings in greater detail, there is illustrated therein a flexible mount header 10 of the present invention. The header 10 is shown with a fuel filter 11 mounted therefrom in a conventional manner.

The header 10 also includes a planar base 12 which is mounted to a supporting structure 13 of an engine 15, such as an intake manifold, near a fuel pump (not shown), which is typically seated at a forward location along the engine 15. Extending upwardly from the base 12 is an integrally formed vertical wall portion 14 which extends to an upper end which supports a horizontally extending filter header portion 16 having conventional means for engaging the fuel filter 11 and a conventional fuel inlet and fuel outlet for connecting the filter into the fuel system of the engine by conventional plumbing 18, typically steel tubing with elastomeric compression fittings.

As stated above, in the event that a front end collision would occur the flexible mount of the filter header 10 will reduce the potential for the fuel filter 11 and associated plumbing 18 thereof to be damaged by engine or vehicle accessories, such as a freon compressor which may be mounted forwardly of the fuel filter 11 and thrust rearwardly against the fuel filter 11. This may be accomplished by incorporating a mounting system 20 which allows for rearward pivotability of the header 10 while maintaining the header 10 upright against forwardly directed inertial forces.

The mounting system 20 is shown to comprise a compression mount 22. The compression mount 22 comprises an elongate stud or bolt 24 having a compression spring 26 of suitable spring rate and predetermined preload mounted thereover, beneath a washer 28 seated under a head 30 of a bolt 24, or beneath a head-forming nut 30 threaded onto a stud 24. The opposite end 32 of the stud or bolt 24 is received through a bore 34 provided therefor in the base 12 of the header 10 and is secured within a predrilled threaded bore 36 created in the engine supporting structure 13. In the preferred embodiment of the header 10, two such compression mounts 22 are provided. It will be understood that sufficient preload is placed on the compression springs 26 during assembly so that no pivoting or relative movement will occur between the header base 12 and the engine support structure 13 during normal operation of a vehicle in which the engine and filter combination of the invention is installed. Also, because of the compressive manner of mounting the base 12, the base 10 is not able to break completely away from its engagement therewith, being constantly downwardly biased by the compression springs 26.

Figure 5:
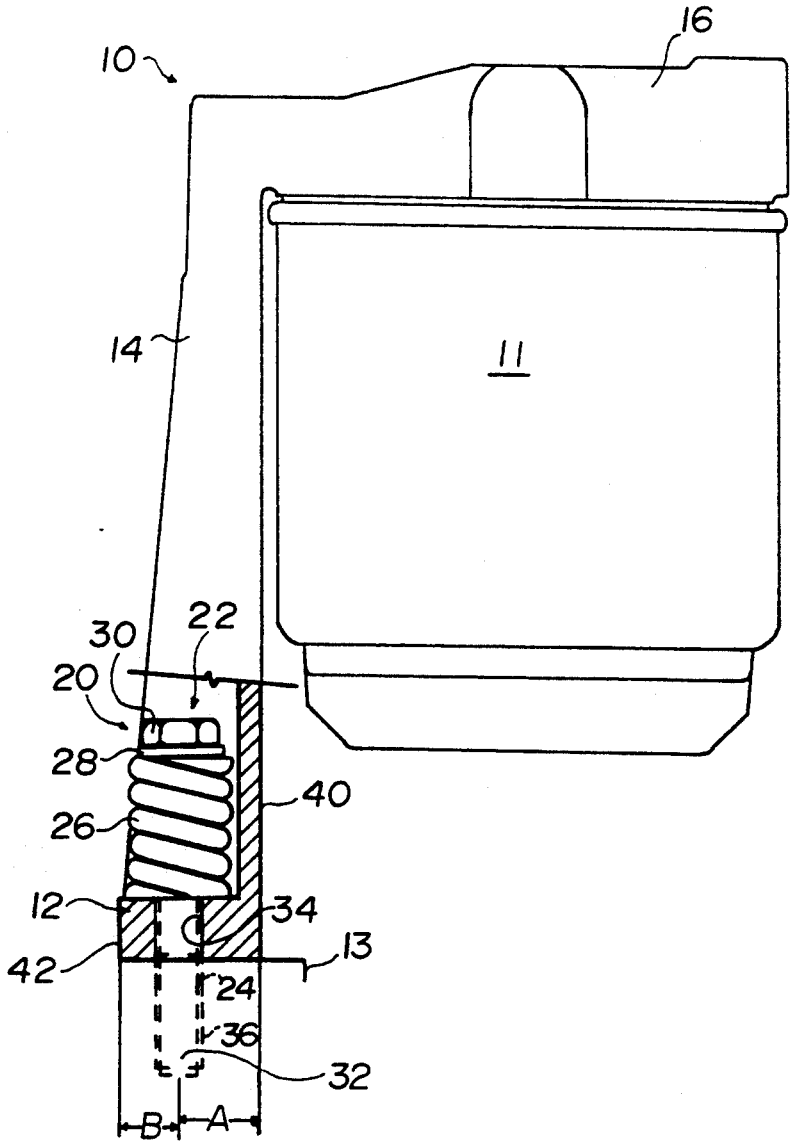
FIG. 5 is a side view of the header of FIG. 1.

Turning to FIG. 5, the positioning of the filter header bores 34 in relation to a forward edge 40 and to a rearward edge 42 of the base 12 is shown. This positioning is considered an important aspect of the system 20. In this respect, to reduce, if not altogether eliminate, the forward pivotability of the header 10, the distance from the center of each bore 34 to the forward edge 40 of the base 12, defined as A in the Figure, is maximized to produce a maximum resistive torque against forward pivoting of the header 10 about its lower leading corner.

Conversely, to reduce the amount of resistive torque to rearward pivoting of the header 10 about its lower rearward corner under impact conditions, the distance between the center of each bore 34 and the rear edge 42 of the base 12, defined as B in the Figure, is as small as possible.

Thus, if the header 10 or filter 11 is struck from in front with a force in excess of a predetermined amount, the header 10 pivots rearwardly against action of the spring 26 and by virtue of the minimized resistive torque against rearward pivoting of the base 12, allows the filter 11 to avoid damage from impact. This pivoting may be relatively small, for example, about 7°, while nevertheless being effective to prevent significant damage to the filter and header and remaining with in a range of movement which will be accommodated without leakage by the fuel lines and their connections to the header.

On the other hand, where the filter 11 or header 10 are not struck in a front end collision, the significant forwardly directed inertial force due to the severe deceleration of an associated vehicle in a collision, will be opposed by the maximized resistive torque created by the larger dimension of the base 12 forwardly of the bore 34 so that the header 10 and filter 11 is kept from pivoting forwardly.

As described above, the flexibly mounted filter header of the present invention has a number of advantages, some of which are described above and others of which are inherent in the invention. Also, modifications can be proposed without departing from the teachings herein. Accordingly, the scope of the invention is only to be limited as necessitated by the accompanying claims.

What is claimed is:

1. In combination with an engine having a supporting structure, a flexible mount header for a fuel filter comprising header means for engaging a fuel filter, said header means having a planar base member disposed in engagement with said engine support structure, and spring biassed means for maintaining said base member and said support structure in engagement while permitting movement of said header upon a predetermined impact force acting thereon.

2. The header of claim 1 wherein said base member has a forward edge, a rear edge and lateral ends.

3. The header of claim 1 wherein said base member has bores drilled therein which are positioned toward the lateral ends and rear edge.

4. The header of claim 3 wherein said compression type mount comprises a bolt having a washer engaged against a head thereof and said spring biased means is a compression spring coiled thereover between said washer and a free end of said bolt.

5. The header of claim 4 wherein the free end of said bolt passes through said base, compressing the spring between said base member and said washer when engaged to the surface underlying the base member.

6. The header of claim 5 wherein the distance between a center point of said bolt and the rear edge of the base member is substantially less than half the distance between the rear edge and a front edge of said base member.

7. The header of claim 6 wherein the distance between a center point of said bolt and the forward edge of said base member is substantially larger than the distance between said center point a said rear edge of said base member.

8. In combination with an engine, a flexible mount fuel filter header including means for engaging a fuel filter and a planar base member which is engaged to an underlying engine surface at least as large as said planar base member by at least one bolt, the bolt having mounted thereon a compression spring between said base member and a head of the bolt, the bolt being positioned substantially closer to a rear edge of the base member than to a front edge of said base member.

9. The header of claim 8 engaging a plurality of bolts.

10. The header of claim 9 engaging two bolts.

11. The header of claim 10 wherein said two bolts are seated toward lateral ends of the planar base member.

12. The header of claim 11 wherein each bolt has a washer mounted thereon between the bolt head and the spring.

13. The header of claim 12 wherein said bolt has a free end which is adapted to pass through a bore in said base member and engage within a corresponding bore in an underlying surface, the spring becoming compressed between said washer and said base member upon such engagement of the bolt.

* * * * *